United States Patent [19]

Burke, Jr.

[11] Patent Number: 5,073,122

[45] Date of Patent: Dec. 17, 1991

[54] LOCK-OUT ENCLOSURE FOR POWER CONNECTOR

[76] Inventor: Ronald A. Burke, Jr., 6650 Loud Dr., Oscoda, Mich. 48750

[ * ] Notice: The portion of the term of this patent subsequent of Sept. 18, 2007 has been disclaimed.

[21] Appl. No.: 527,014

[22] Filed: May 22, 1990

Related U.S. Application Data

[63] Continuation of Ser. No. 339,645, Apr. 18, 1989, Pat. No. 4,957,445.

[51] Int. Cl.[5] ..... H01R 13/44

[52] U.S. Cl. ..... 439/134; 439/304; 439/707

[58] Field of Search ..... 439/133, 134, 304, 308, 439/707

[56] References Cited

U.S. PATENT DOCUMENTS 4,679,873 7/1987 Brackett, Jr. ..... 439/134
4,957,445 9/1990 Burke, Jr. ..... 439/134

*Primary Examiner*—Paula A. Bradley
*Attorney, Agent, or Firm*—Remy J. VanOphem

[57] ABSTRACT

A tubular enclosure for a power connector attached to a power supply line, whereby the enclosure can be moved along the line to a position enclosing the power connector; the enclosure serves as a lock-out device to prevent the connection of the power connector to a power source by unauthorized or untrained persons. In a preferred form of the invention the enclosure is permanently retained on the power line so that it is readily available for use when needed for the lock-out function.

23 Claims, 1 Drawing Sheet

LOCK-OUT ENCLOSURE FOR POWER CONNECTOR

This is a continuation of application Ser. No. 07/339,645, filed Apr. 18, 1989, now U.S. Pat. No. 4,957,445.

BACKGROUND OF THE INVENTION

1. Field of the Invention

This invention relates to an enclosure for a power connector, e.g. an electrical connector, a hydraulic fluid connector or a compressed air line connector. The enclosure is used to prevent the power connector from being connected to a power source thereby preventing unauthorized use of power equipment, e.g. a television set, computer, air-operated drill, etc.

2. Description of the Prior Art

The prior art includes some patents disclosing protective enclosures for electrical connectors. U.S. Pat. No. 4,673,230 to H. Baumgart shows a protective enclosure for an electrical connector. A padlock is extended through apertures in the enclosure walls to retain the connector within the enclosure.

One difficulty with the arrangement of U.S. Pat. No. 4,673,230 is the fact that the enclosure cannot be installed onto the connector until the connector has first been disconnected from the associated power line or the power line has been disconnected from the associated appliance. Another difficulty concerns a possible inoperable relationship between the enclosure and padlock. Installation of the lock would be difficult or impossible, due to the physical impossibility of extending the U-shaped lock shackle through the apertures.

U.S. Pat. No. 4,488,764 to B. Pfenning shows a rectangular box-like enclosure for an electrical connector. A cover is openable to permit insertion and removal of the connector. The connector may be located within the box-like enclosure to prevent its unauthorized insertion into a source of electrical power and a key lock is built into the cover to prevent access to the connector. The connector may be operatively positioned outside the box-like enclosure, with the associated power line extending through the box-like enclosure, as shown in FIG. 10 of the patent.

One drawback with the arrangement of U.S. Pat. No. 4,488,764 is the fact that the box-like enclosure is separable from the electrical connector plug and associated power line. When the cover is removed from the enclosure, it is possible to lay the enclosure and cover aside where they can easily be forgotten or lost. It is advantageous to have the enclosure permanently connected to the power line, so that it cannot be mislaid or forgotten. The arrangement of U.S. Pat. No. 4,488,764 does not provide this feature.

Another disadvantage of the device shown in U.S. Pat. No. 4,488,674 is a relatively high manufacturing cost. A rectangular box of the type shown in the patent is manufactured out of sheet metal by stamping a blank from flat sheet stock, bending the blank at right angles to form the box sidewalls, and welding adjacent edges to the walls. Separate operations are required to form the cover and the structure for locking the cover on the enclosure.

It is believed that the protective enclosure will be more effective as a safety device if it is formed of a dielectric material, e.g. nonconductive plastic.

The lock-out enclosure of U.S. Pat. No. 4,488,764 also has the disadvantage of being unnecessarily large for its function. The square-shaped enclosure does not conform to the shape of the connector; therefore, there is considerable unused space within the enclosure. The lock arrangement used in U.S. Pat. No. 4,488,764 also contributes to an undesired bulkiness of the enclosure. As seen in FIG. 3 of the patent, the lock projects a considerable distance into the enclosure (approximately forty percent of the distance from the cover to the bottom wall of the enclosure). The disposition of the lock within the enclosure potentially interferes with the plug, such that the enclosure needs to be made larger than would otherwise be necessary.

The bulkiness of the enclosure disclosed in U.S. Pat. No. 4,488,764 is disadvantageous in that manufacturing costs are increased due to excessive raw material expense. The bulkiness of the enclosure is also disadvantageous in that the weight of the enclosure can inadvertently disconnect the connector from the associated outlet when the connector is removed from the enclosure and the enclosure remains attached to the power line.

U.S. Pat. No. 4,592,607 to R. Pejovic overcomes some of the disadvantages of the enclosure shown in U.S. Pat. No. 4,488,764. Pejovic discloses an enclosure formed by two rectangular hollow half-sections. The rectangular shape of this enclosure does not conform to the shape of the associated connector and like the enclosure taught by Pfenning is not very space efficient. Further, Pejovic's enclosure is completely separable from the power line and, hence, susceptible to being mislaid, lost, stolen, or otherwise not available when needed.

U.S. Pat. No. 4,721,475 to Burke, Jr. discloses a tubular enclosure enclosing both a male connector and female connector. The tubular shape shown in this patent has a relatively good space utilization because there is relatively little unused space within the enclosure. However, the enclosure taught by Burke, Jr. was designed to house both the male and the female connector in connected and disconnected states; therefore, the enclosure is relatively large in an absolute sense. Also, the structure taught by Burke, Jr. is designed so that the connectors are fixedly attached to the enclosure components. The connectors must be disconnected from their associated power lines 12 and 14 before they can be attached to the respective enclosure components.

SUMMARY OF THE INVENTION

The present invention relates to a lock-out enclosure for a power connector which includes a tubular enclosure that is only slightly larger than the connector. A cap is installed on one end of the tubular enclosure. Installation of the cap onto a power line is made possible by a radial slot extending part way therethrough. After the cap is located on the power line, the tubular enclosure is slid over the connector and onto the cap. The cap is then permanently attached to the tubular enclosure using an adhesive or locking means to form an enclosure assembly.

The enclosure assembly can be slid over the associated connector to prevent access to the connector. The enclosure assembly can also be slid along the power line away from the connector, but it cannot be removed from the power line. A principal aim of the invention is to provide a compact low cost lock-out enclosure for a connector, wherein the enclosure is permanently attached to the associated power line and readily available when needed.

DETAILED DESCRIPTION OF THE PREFERRED EMBODIMENT

Figure 3:
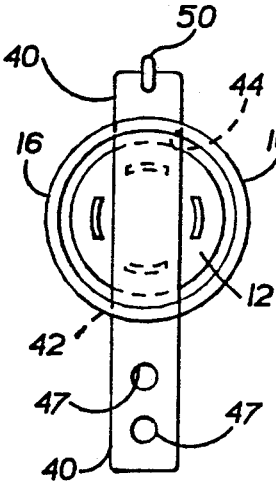
FIG. 3 is a left end elevational view of the FIG. 1 enclosure.
Figure 1:
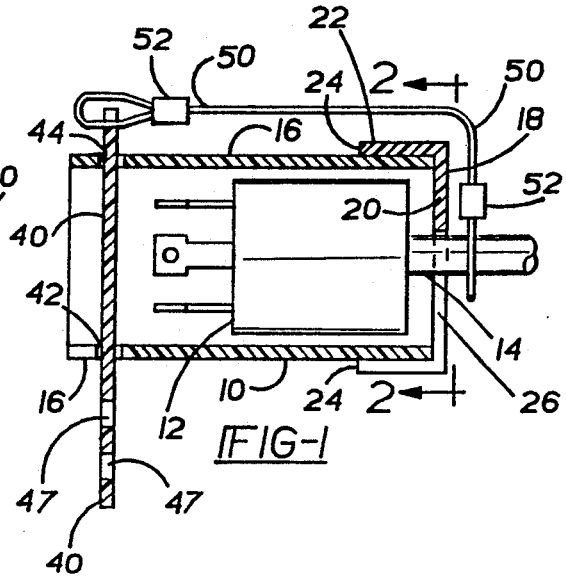
FIG. 1 is a sectional view taken through an enclosure constructed according to the invention.
Figure 2:
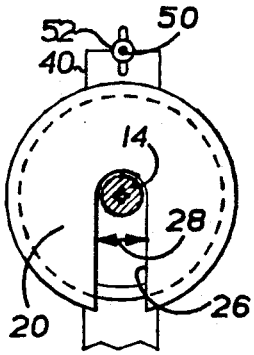
FIG. 2 is a sectional view taken along line 2—2 in FIG. 1.

FIGS. 1 through 3 show a lock-out enclosure 10 for a connector 12 illustrated as a male electrical wall plug attached to an electrical power line 14. The non-illustrated end of the power line 14 is connected to a machine or appliance, such as a lathe or television set. The connector 12 is designed to be received into an electrical outlet or a female connector on an extension cord.

In the drawings the connector 12 is shown as an electrical plug, however, it can be a hydraulic fluid connector attached to a hydraulic line, or a pneumatic connector attached to a compressed air line.

The enclosure 10 includes a cylindrical tube 16 and a cap 18 permanently attached to one end of the tube. Both the tube and the cap are preferably formed of a dielectric (plastic) material. The cap 18 constitutes a circular end wall 20 and a cylindrical flange 22 having a free edge 24. A slot 26 extends from the free edge 24 through the cylindrical flange 22 and through the end wall 20 from the flange 22 to a central region thereof. The slot has a transverse width dimension 28 slightly greater than the diameter of the power line 14.

Figure 7:
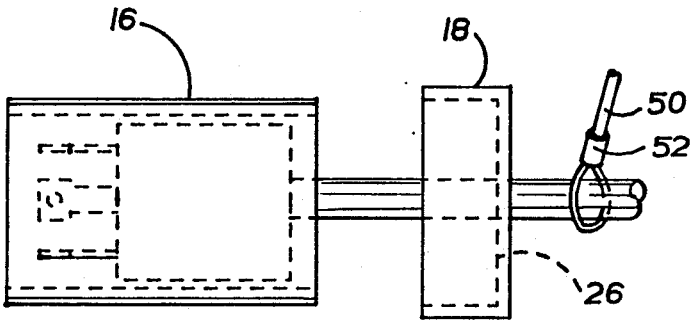
FIG. 7 is a semi-structural representation of the FIG. 1 assembly, with component parts detached.

FIG. 1 shows the cylindrical flange 22 of the cap 18 telescoped onto the tube 16. However, the cap 18 is initially separated from the tube 16 as shown in FIG. 7. The slot 26 permits the cap 18 to receive the power line 14 therethrough. When the cap 18 is in the position shown in FIG. 7, the adjacent end of the tube 16 can be inserted into the cap 18 as shown in FIG. 1. Prior to insertion of the tube 16 into the cap 18, the outer circumferential surface of the tube, adjacent to the end thereof, is coated with an adhesive. Accordingly, when the tube is inserted into the cap, the cap 18 becomes permanently attached to the tube, thereafter, the tube/cap assembly is permanently retained on the power line. The assembly can be slid to the right, as shown in FIG. 1, away from the connector 12 but it cannot be removed from the power line.

The other end of the tube 16, the left end as shown in FIG. 1, is releasably closed by a transverse bar 40 that may be constructed similarly to the bar shown in the aforementioned U.S. Pat. No. 4,721,475. The bar 40 is adapted for manual insertion through slot-like apertures 42 and 44 in the wall of the tube 16. Openings 47 in the bar 40 can selectively accommodate a commercially available padlock, not shown, to prevent removal of the bar 40 from the tube 16 and the connection of the connector 12 to a source of power.

The use of a multiplicity of openings 47 is to adapt the lock-out enclosure to industrial environments or establishments, where different departments are responsible for the system to which it is attached, e.g. maintenance, quality control, the tool room or machine set up. Each department would be assigned a different one of the openings 47. A knowledgeable person could then observe the location of the padlock to determine who had placed the padlock on the bar 40. The number of openings 47 is determined by the number of departments having a responsibility for the system.

The bar 40 is connected to the power line 14 via a flexible cable 50. Opposite ends of the cable are formed into loops, after which metal sleeves 52 are crimped onto the cable sections to form permanent connections. The crimping operations are performed at initial installation of the enclosure system on a power line 14. During service the cable and bar 40 are permanently attached to the power line 14. The cable is of sufficient length as to permit insertion or removal of the bar 40 into or out of the apertures 42 and 44 in the tube 16.

The lock-out enclosure shown in FIGS. 1 through 3 requires two operations to install it on the power line 14, i.e. crimping the clamping sleeves 52 onto the cable 50, and permanently attaching the cap 18 to the tube 16. The connection between the power line 14 and connector 12 can remain intact undisturbed during the installation of the lock-out enclosure. The system shown in FIG. 1 becomes a permanent part of the power connection system, therefore, it is always available when needed to enclose the connector 12 for lock-out purposes.

Figure 4:
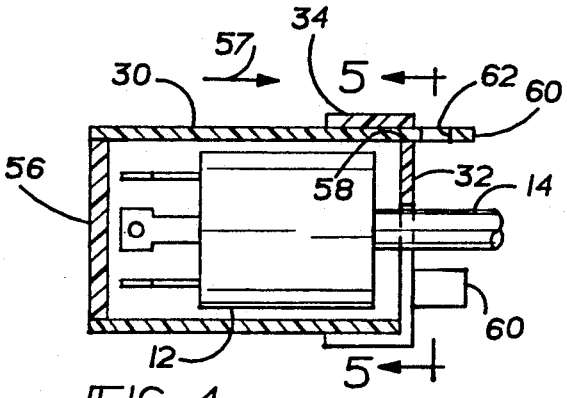
FIG. 4 is a sectional view taken through a second embodiment of the invention.
Figure 5:
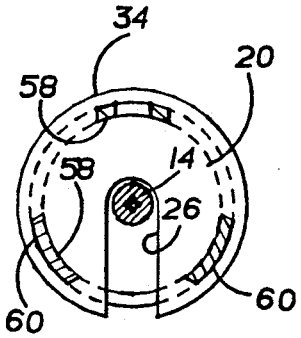
FIG. 5 is a sectional view taken along line 5—5 in FIG. 4.

FIGS. 4 and 5 show a second embodiment of the invention, wherein the tube and cap are removable from the power line 14. In this case, a cylindrical tube 30 has an end wall 56 permanently closing one end of the cylindrical tube. The tube is installed over the connector 12 by a rightward movement in the direction of arrow 57 as shown in FIG. 4.

An end cap 32 has three circumferentially spaced arcuate slots 58. The tube 30 has three axially extending fingers 60 alignable with the arcuate slots 58. One of the fingers has an opening 62 therethrough adapted to receive a padlock, not shown. When the tube and cap are telescoped together, as shown in FIG. 4, the shackle of a padlock can be inserted through the opening 62 to lock the end cap 32 to the end of tube 30 with the connector 12 enclosed therein.

Figure 6:
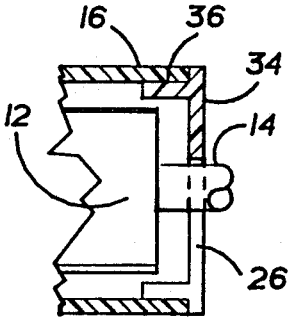
FIG. 6 is a fragmentary sectional view through a cap structure that can be used as an alternative to the cap structure shown in FIG. 1.

FIG. 6 shows an alternate embodiment of the cap 18 described with reference to FIG. 1. In FIG. 6 a cap 34 has a cylindrical flange 36 located inwardly from the peripheral edge of the cap. The flange 36 telescopes into the end of the tube 16, rather than circumscribing the outer surface of the tube. An adhesive can be brushed onto the outer surface of the flange 36 to permanently attach the cap 34 to the tube 16.

An important feature of the invention is the slot 26 which extends through the flange 22 and through the end wall 20 from the flange 22 to a central portion thereof. This construction enables the cap to be installed onto the power line 14 in a position in axial alignment with the tube 16. In the preferred embodiment of the invention illustrated in FIG. 1, the cap is permanently attached to the tube 16, such that the tube/cap assembly is permanently retained on the power line 14 and is readily available when needed for the lock-out function. The tube 16 preferably has an inside diameter that is only slightly greater than the profile dimension of the connector 12, so as to minimize the size and weight of the lock-out enclosure 10.

Figure 8:
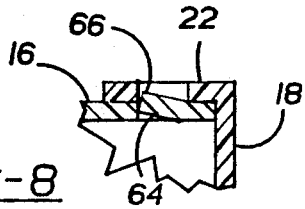
FIG. 8 is a fragmentary sectional view of a structural detail that can be used in the FIG. 1 assembly.

Although the preferred mechanism for joining the cap 18 to the tube 16 is an adhesive, other mechanisms can be used. FIG. 8 shows an arrangement wherein a resilient tang 64 is formed on the tube 16 for snap-on engagement into an opening 66 provided in the flange 22 of the cap 18 when the tube 16 is inserted into the cap 18.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A lock-out enclosure for a connector attached to a power supply line comprising:

a cylindrical tube receivable over said connector, said cylindrical tube having a first end and a second end opposite said first end, both said first end and said second end being open;

a cap mounted to said first end of said cylindrical tube, said cap having an end wall, a cylindrical flange extending in a direction normal to said end wall, and a power line slot extending through said end wall to a central region thereof;

means for permanently locking said cylindrical flange to said first end of said cylindrical tube, said means preventing removal of said cap from said first end of said cylindrical tube once said cylindrical flange is locked to said first end; and closure means for closing said second end of said cylindrical tube opposite said one end to prevent the removal of said connector from inside said cylindrical tube.

2. The lock-out enclosure of claim 1 wherein said means for permanently locking is at least one aperture provided in said cylindrical flange and at least one resilient tang provided on said cylindrical tube lockingly engaging said at least one aperture in a snap lock manner.

3. The lock-out enclosure of claim 1 wherein said closure means is a closure bar extendable through two diametrically opposed slots provided through said cylindrical tube adjacent to said second end of said cylindrical tube opposite said first end to prevent the removal of said connector from said cylindrical tube and prevent the connection of said connector to a source of power.

4. The lock-out enclosure of claim 1 wherein said means for permanently locking said cap to said first end of said cylindrical tube is an adhesive binding said cylindrical flange to said cylindrical tube.

5. The lock-out enclosure of claim 4 wherein the internal diameter of said cylindrical flange is approximately equal to the external diameter of said cylindrical tube so that said cylindrical tube is telescopically received inside of said cylindrical flange.

6. The lock-out enclosure of claim 4 wherein the external diameter of said cylindrical flange is approximately equal to the internal diameter of said cylindrical so that said cylindrical flange is telescopically received inside of said cylindrical tube.

7. A lock-out enclosure for a connector attached to a power supply line comprising:

a cylindrical tube sized to be received over said connector, said cylindrical tube having a closed end, an open end and at least one finger axially extending from said open end of said cylindrical tube, said at least one finger having an aperture provided therethrough to receive the shackle of a lock; and a cap for enclosing said open end of said cylindrical tube, said cap having an end wall, a cylindrical flange circumscribing said cylindrical tube and a radial slot for receiving said power supply line therethrough, said cap further having at least one arcuate slot receiving said at least one finger therethrough.

8. The lock-out enclosure of claim 7 wherein said at least one finger is three fingers and said at least one arcuate slot is three arcuate slots aligned with said three fingers.

9. An enclosure for a connector attached to a power supply line comprising:

a tube sized to be slipped over said connector;

a cap mountable to one end of said tube, said cap having an end wall and a slot extending through said end wall, said slot having a transverse width sufficient to receive said power supply line therethrough; and an adhesive binding said cap to said one end of said tube to lock said enclosure to said connector.

10. The enclosure of claim 9 wherein said tube and said cap are formed of a dielectric material.

11. The enclosure of claim 9 wherein said connector is an electrical connector.

12. The enclosure of claim 9 wherein said connector is a hydraulic connector.

13. The enclosure of claim 9 wherein said connector is a pneumatic connector.

14. The enclosure of claim 9 further comprising removable closure means for closing the end of said tube opposite said one end.

15. The enclosure of claim 14 wherein said tube has two diametrically spaced openings in near adjacency to said end of said tube opposite said one end, said removable closure means is a closure bar extendable through said two diametrically spaced openings, said closure bar assuming an obstructing position preventing the connection of said connector to a source of power.

16. An enclosure for a connector attached to a power supply line comprising:

a tube sized to be slipped over said connector;

a cap mountable to one end of said tube, said cap having an end wall and a slot extending through said end wall, said slot having a transverse width sufficient to receive said power supply line therethrough; and removable closure means for closing the end of said tube opposite said one end.

17. The enclosure of claim 16 wherein said tube has two diametrically spaced openings in near adjacency to said end of said tube opposite said one end, said removable closure means is a closure bar extendable through said two diametrically spaced openings, said closure bar assuming an obstructing position preventing the connection of said connector to a source of power.

18. An enclosure for a connector attached to a power supply line comprising:

a tube sized to be slipped over said connector;

a cap mountable to one end of said tube, said cap having an end wall, a cylindrical flange extending from said end wall, and a slot extending through said end wall, said slot having a transverse width sufficient to receive said power supply line therethrough, said cylindrical flange having at least one opening provided therethrough; and at least one resilient tang located at said one end of said tube, said at least one resilient tang engaging said at least one opening in said cylindrical flange in a snap lock engagement.

19. The enclosure of claim 18 further comprising removable closure means for closing the end of said tube opposite said one end.

20. The enclosure of claim 19 wherein said tube has two diametrically spaced openings in near adjacency to said end of said tube opposite said one end, said removable closure means is a closure bar extendable through said two diametrically spaced openings, said closure bar assuming an obstructing position preventing the connection of said connector to a source of power.

21. An enclosure for a connector attached to a power supply line comprising:

a tube sized to be slipped over said connector, said tube having at least one axially extending finger extending from one end thereof, said at least one axially extending finger having an aperture therethrough to receive a shackle of a lock; and a cap connectable to one end of said tube, said cap having an end wall and a slot extending through said end wall, said slot having a transverse width sufficient to receive said power supply line therethrough, said cap further having at least one arcuate slot for receiving said axially extending finger therethrough.

22. The enclosure of claim 21 wherein said tube has an end wall enclosing the end of said tube opposite said one end.

23. The enclosure of claim 22 wherein said at least one arcuate slot is three equally spaced arcuate slots and said at least one axially extending finger is three equally spaced axially extending fingers, each of said three axially extending fingers extending through a respective one of said three equally spaced arcuate slots.

* * * * *

UNITED STATES PATENT AND TRADEMARK OFFICE

CERTIFICATE OF CORRECTION

PATENT NO. : 5,073,122

DATED : December 17, 1991

INVENTOR(S) : Roland A. Burke, Jr.

It is certified that error appears in the above-identified patent and that said Letters Patent is hereby corrected as shown below:

Title page, item [76], should read --Roland A. Burke, Jr.--.

Column 5, line 68, after "cylindrical" insert --tube--.

Signed and Sealed this

Twentieth Day of April, 1993

*Attest:*

MICHAEL K. KIRK

*Attesting Officer*

*Acting Commissioner of Patents and Trademarks*